US008651476B2

(12) United States Patent
Bingham et al.

(10) Patent No.: US 8,651,476 B2
(45) Date of Patent: Feb. 18, 2014

(54) SEPARATOR ASSEMBLY

(75) Inventors: Jeffrey G Bingham, Vancouver, WA (US); Devin S. Uehling, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/482,370

(22) Filed: May 29, 2012

(65) Prior Publication Data

US 2013/0320610 A1 Dec. 5, 2013

(51) Int. Cl.
*B65H 3/52* (2006.01)

(52) U.S. Cl.
USPC ..... 271/121

(58) Field of Classification Search
USPC ..... 271/10.11, 161, 167, 109, 121
See application file for complete search history.

(56) References Cited

U.S. PATENT DOCUMENTS

| | | | | |
|---|---|---|---|---|
| 5,000,438 | A | 3/1991 | Sardano et al. | |
| 5,265,856 | A | 11/1993 | Walker | |
| 6,893,014 | B2 | 5/2005 | Baker et al. | |
| 6,939,068 | B2 | 9/2005 | Rawlings et al. | |
| 7,299,000 | B2 | 11/2007 | Taira et al. | |
| 7,959,151 | B2 | 6/2011 | Fukube | |
| 8,474,813 | B2 * | 7/2013 | Cheng et al. | 271/121 |
| 2002/0117800 | A1 * | 8/2002 | Kawarama et al. | 271/121 |
| 2003/0132570 | A1 * | 7/2003 | Park | 271/167 |
| 2005/0275156 | A1 * | 12/2005 | Flynn et al. | 271/167 |
| 2009/0079127 | A1 * | 3/2009 | Bokelman et al. | 271/121 |

FOREIGN PATENT DOCUMENTS

| | | | | |
|---|---|---|---|---|
| JP | 05201570 A | * | 8/1993 | B65H 3/52 |
| JP | 10114444 A | | 5/1998 | |

* cited by examiner

*Primary Examiner* — Jeremy R Severson

(57) ABSTRACT

A separator assembly is disclosed herein. An example includes a base to mount to a printing device and a wall supported by the base. The example also includes a singulation assembly adjacent the wall to separate a medium from a media stack and a ramp adjacent the singulation assembly to guide the medium from the media stack to a feed assembly. The example further includes a corner relief feature on either side of and below the ramp into which corners of the medium may drop and travel below a remainder of the medium as the medium is guided from the media stack to the feed assembly and a guide adjacent each corner relief feature to lift the corners of the medium out of the corner relief features before the medium enters the feed assembly. A media handling assembly is also disclosed herein as is a method of media handling.

18 Claims, 8 Drawing Sheets

SEPARATOR ASSEMBLY

BACKGROUND

Consumers appreciate reliability and performance in printing devices. Damaged printed output is undesirable and can lead to frustration on the part of such consumers. In some cases, it can also cause print medium jams which consumers must clear in order to continue to use such printing devices. Such problems can result in lost sales, warranty service support costs, and even printing device returns for businesses. Businesses may, therefore, endeavor to design printing devices directed toward mitigating such problems.

BRIEF DESCRIPTION OF THE DRAWINGS

The following detailed description references the drawings, wherein.

DETAILED DESCRIPTION

Reliability and performance of printing devices are desirable. Throughput, such as printed sheets per minute, is also desirable as is quality of printed output. The ability to utilize a variety of different sizes (e.g., letter, legal, A4, A3, etc.) and types of media (e.g., glossy, matte, plain, etc.) while maintaining quality of printed output, as well as minimizing downtime due to medium jams within printing devices is also a design consideration. This helps maintain consumer satisfaction which mitigates lost sales, warranty service support costs, and printing device returns for businesses. An example of a media handling assembly 10 directed toward such objectives is disclosed in FIG. 1.

As used herein, the terms "non-transitory storage medium" and non-transitory computer-readable storage medium" are defined as including, but not necessarily being limited to, any media that can contain, store, or maintain programs, information, and data. Non-transitory storage medium and non-transitory computer-readable storage medium may include any one of many physical media such as, for example, electronic, magnetic, optical, electromagnetic, or semiconductor media. More specific examples of suitable non-transitory storage medium and non-transitory computer-readable storage medium include, but are not limited to, a magnetic computer diskette such as floppy diskettes or hard drives, magnetic tape, a random access memory (RAM), a read-only memory (ROM), an erasable programmable read-only memory (EPROM), a flash drive, a compact disc (CD), or a digital video disk (DVD).

As used herein, the term "processor" is defined as including, but not necessarily being limited to, an instruction execution system such as a computer/processor based system, an Application Specific Integrated Circuit (ASIC), or a hardware and/or software system that can fetch or obtain the logic from a non-transitory storage medium or a non-transitory computer-readable storage medium and execute the instructions contained therein. "Processor" can also include any controller, state-machine, microprocessor, cloud-based utility, service or feature, or any other analogue, digital and/or mechanical implementation thereof.

As used herein "printing device" is defined as including, but not necessarily being limited to, a printer that uses any of the following marking technologies or a combination thereof: ink jet, laser jet, dye sublimation, liquid toner, off-set printing, or dot matrix. As used herein "media" is defined as including, but not necessarily being limited to any type of paper or other printing medium (e.g., cloth, canvas, transparency, etc.), having any type of finish on either or both sides (e.g., glossy, matte, plain, textured, etc.), in any size, shape, color, or form (e.g., sheet, roll (cut or uncut), folded, etc.).

Figure 1:
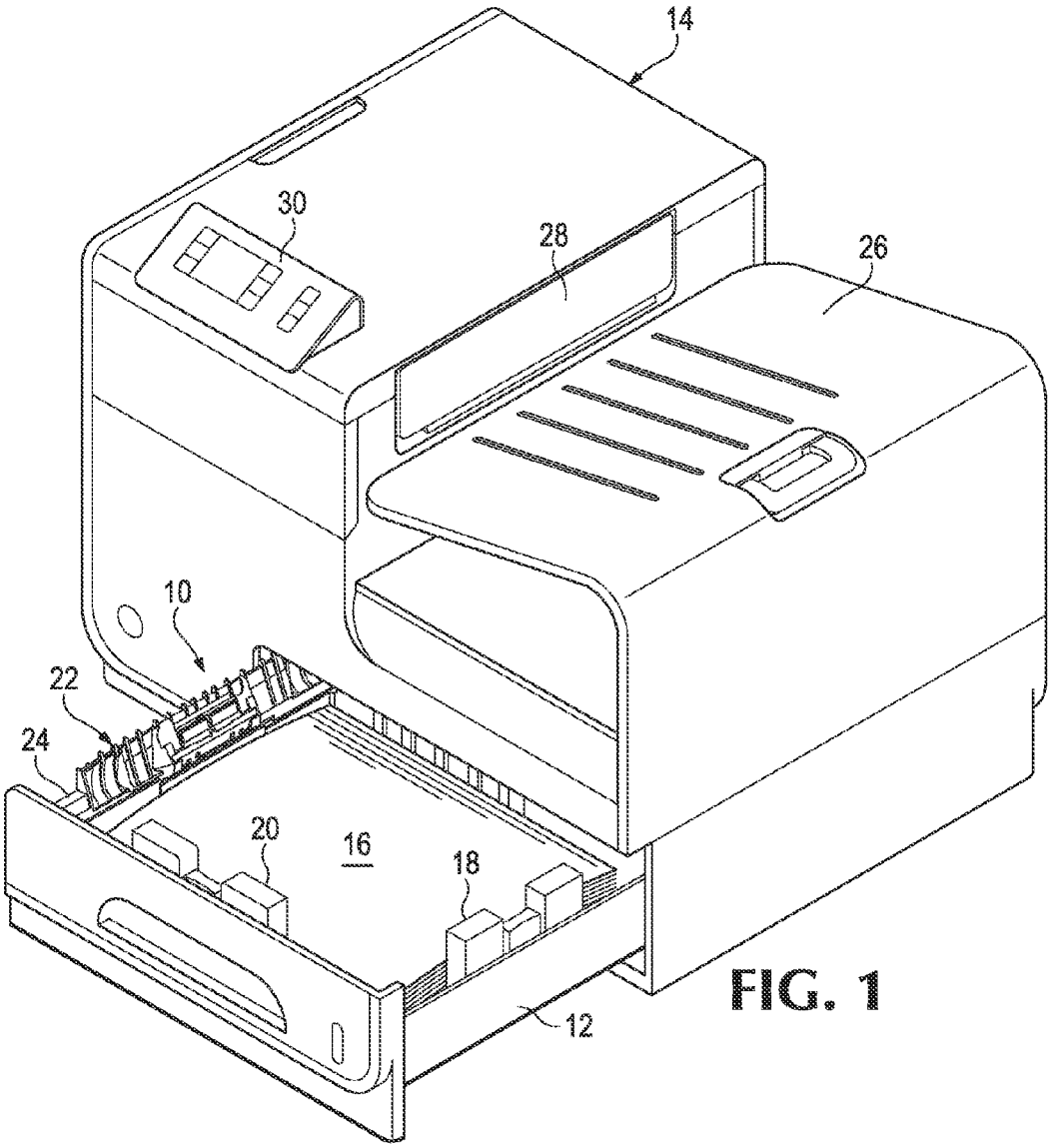
FIG. 1 is an example of a media handling assembly in a printing device.

As can be seen in FIG. 1, media handling assembly 10 is part of an input tray 12 of a printing device 14. Input tray 12 is shown in an open or accessible position with a visible media stack 16. Input tray 12 includes a length adjuster 18 and a width adjuster 20 allowing it to accommodate a variety of different sized media. A separator assembly 22 (discussed in more detail below) is located on an end 24 of input tray 12 opposite length adjuster 18.

As can also be seen in FIG. 1, printing device 14 includes an output tray or shelf 26 adjacent output door 28 where printed media is collected for retrieval by one or more end users. A user interface 30 provides information e.g., print job status, supplies status, etc.) to one or more end users of printing device 14, as well as allowing such end users to enter information (e.g., user ID, print job ID, etc.) relating to their use of printing device 14.

Figure 2:
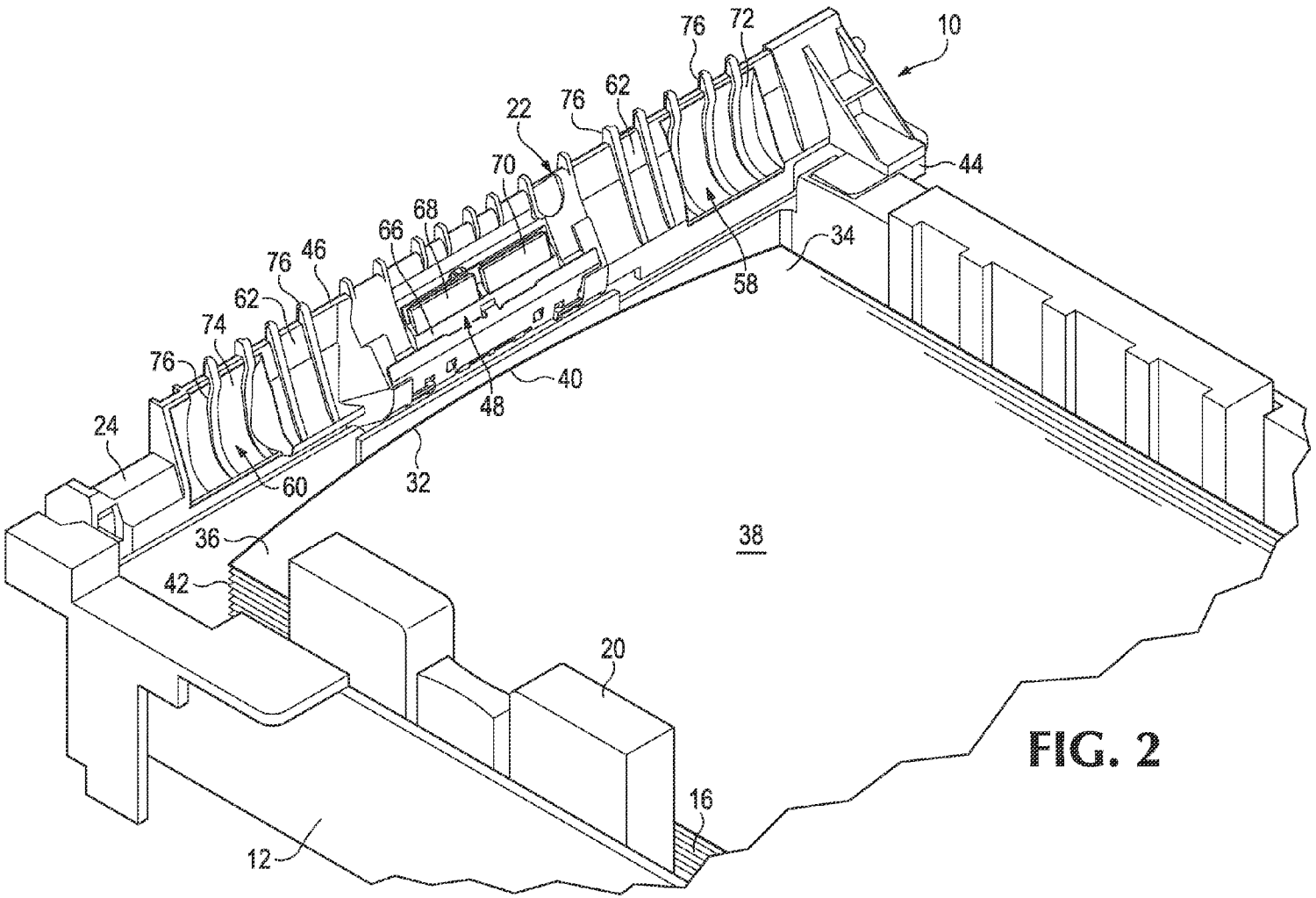
FIG. 2 is a perspective view of a portion of an input tray showing an example of a separator assembly.

A perspective view of a fragmented portion of input tray 12 illustrating separator assembly 22 is shown in FIG. 2. As can be seen in FIG. 2, media stack 16 has a bow 32 in a downward direction toward input tray 12. Bow 32 causes corners 34 and 36 of sheet of medium 38 to lie below center 40 of sheet of medium 38. Bow 32 also exists for those sheets of medium 42 below sheet 38 in input tray 12. As can also be seen in FIG. 2, separator assembly 22 includes a base 44 to mount to input tray 12 of printing device 14 and a wall 46 supported by base 44. As can be further seen in FIG. 2, separator assembly 22 includes a singulation assembly 48 adjacent wall 46 to separate medium 38 from media stack 16, as discussed in more detail below.

Figure 3:
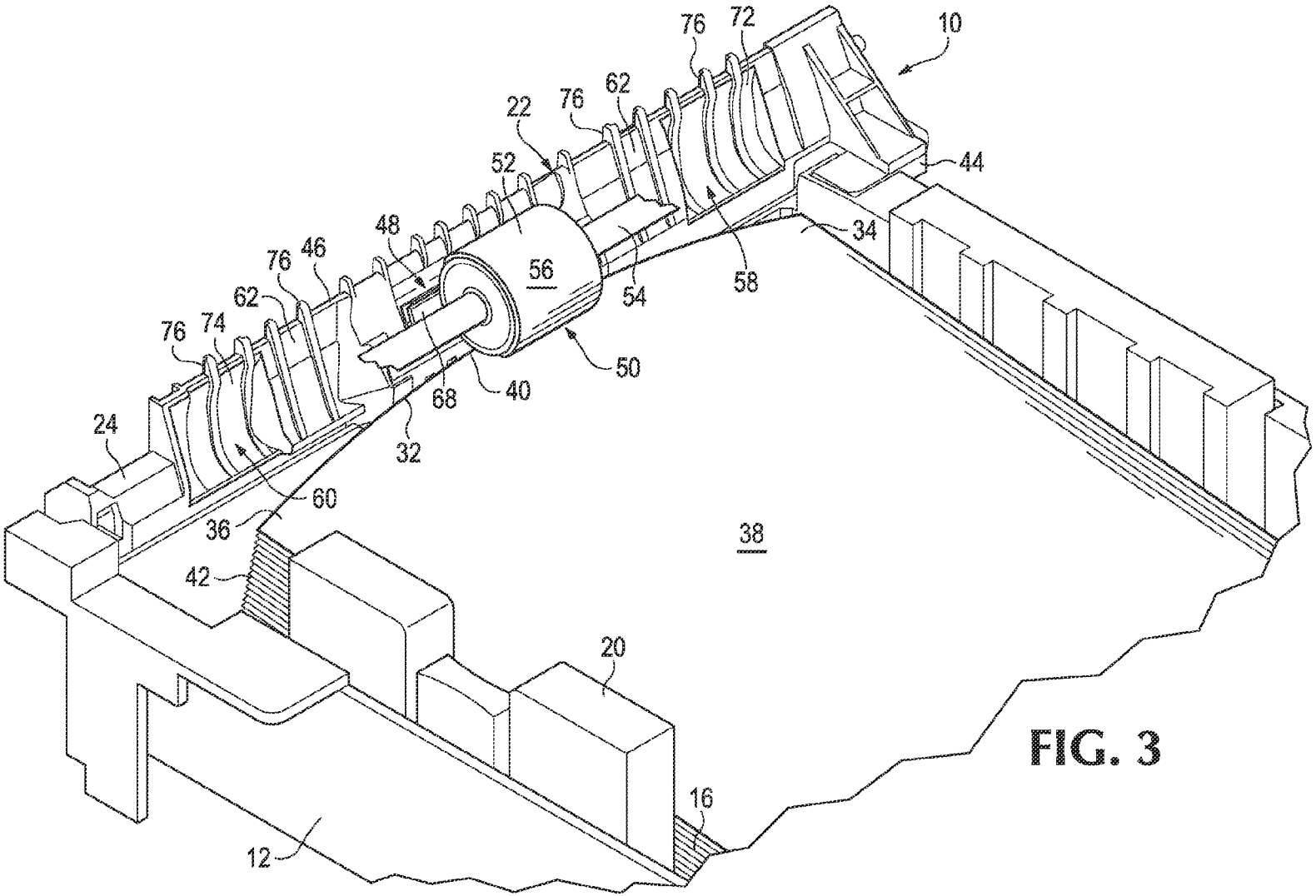
FIG. 3 is the perspective view of FIG. 2 with the addition of an example of a portion of a pick assembly.

FIG. 3 shows a fragmented portion of a pick assembly 50 added to the perspective view of FIG. 2. As can be seen in FIG. 3, pick assembly 50 is positioned adjacent singulation assembly 48 to select medium 38 from media stack 16. Pick assembly includes a pick roller 52 on a rotatable shaft 54. A pick tire 56 is attached to pick roller 52 and may be made from for example, an elastomeric material such as rubber having a sufficient friction to grab medium 38 and feed it into printing device 14 along wall 46 of separator assembly 22.

Figure 4:
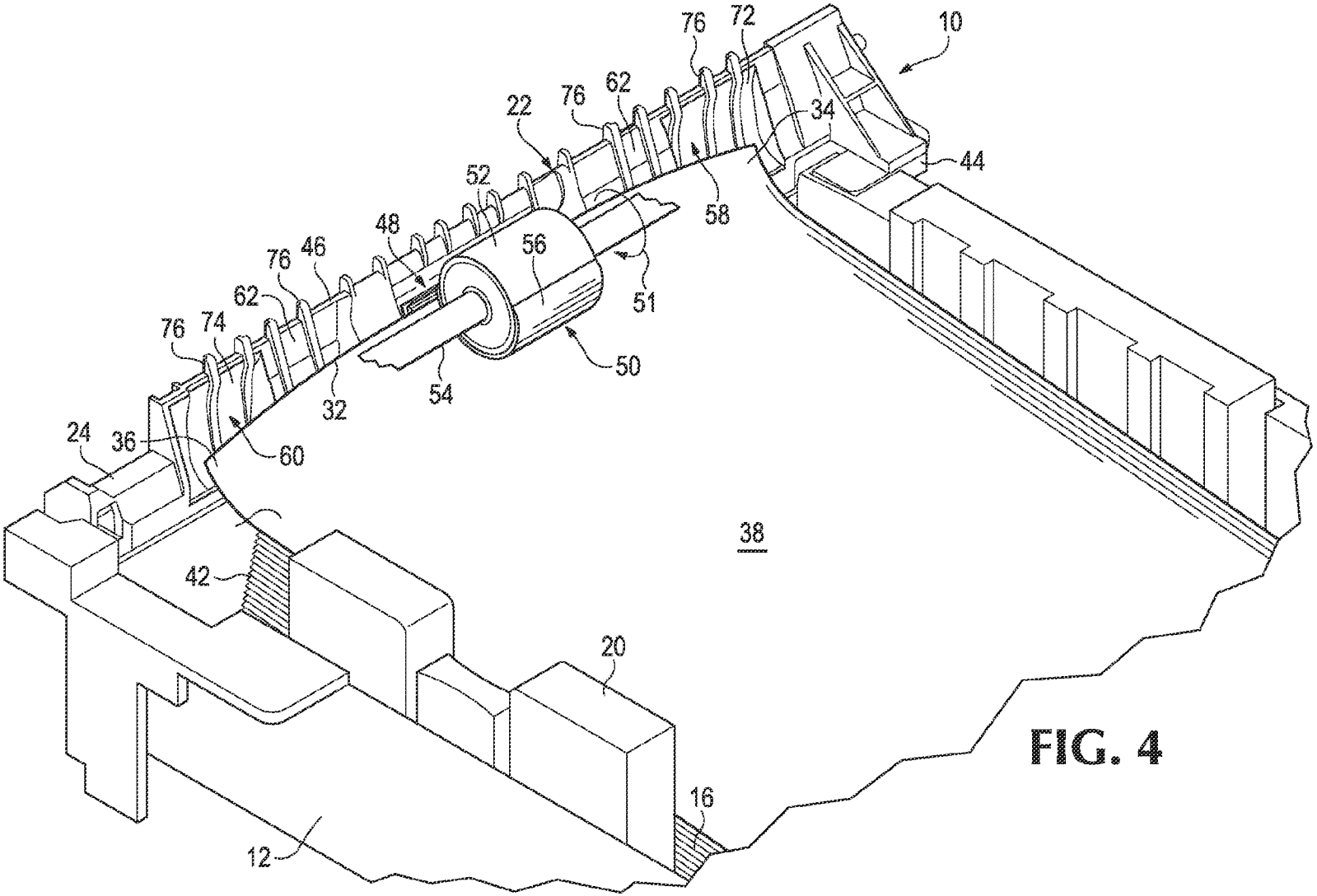
FIG. 4 is the perspective view of FIG. 3 showing an example of a sheet of medium being bent as it travels along a wall of the separator assembly.

When media stack 16 lies flat, damage to corners 34 and 36 of selected sheet of medium 38 is unlikely, as it is conveyed along wall 46 of separator assembly 22. However, if media stack 16 has a bow 32, like that shown in FIGS. 2 and 3, for example, then corners 34 and 36 of selected sheet of medium 38 can come into contact with separator wall 46 before center 40 of selected sheet of medium 38 is bent as it is pushed along wall 46 of separator assembly 22 by pick assembly 50 rotating in the direction of arrow 51, as shown in FIG. 4. This contact can cause either or both of corners 34 and 36 to catch on wall 46 and fold over causing damage to sheet of medium 38 commonly known as a "dog ear" or corner fold. Such dog-eared or corner-folded media damage is displeasing to end-users of printing device 14. It can also cause jams within printing device 14 which must be cleared by an end-user. Furthermore, such dog-eared or corner-folded media can cause printing defects on sheet of medium 38 and even damage the printing mechanism printheads) of printing device 14. These problems caused by such dog-eared or corner-folded media are alleviated by corner relief features 58 and 60 (discussed in more detail below) which delay corners 34 and 36 contact with wall 46 of separator assembly 22 until after center 40 of sheet of medium 38 is bent up wall 46, as shown, for example, FIG. 4.

Referring again to FIG. 2, separator assembly 22 includes a ramp 62 adjacent and on either side of singulation assembly 48 to guide medium 38 from media stack 16 to a feed assembly 64 (see FIGS. 5 and 6) of printing device 14. Singulation assembly 48 includes an inclined plane 66 used to separate medium 38 from media stack 16. Singulation assembly 48 may also include a pair of separator pads 68 and 70 which are attached to incline plane 66 and are used to further assist in separating sheet of medium 38 from media stack 16 during selection by pick assembly 50. Separator pads 68 and 70 may be made from, for example, an elastomeric material, such as rubber. Corner relief features 58 and 60 are located on either side of and below ramp 62 so that corners 34 and 36 may drop into and travel below the remainder of medium 38 as medium 38 is guided from media stack 16 to feed assembly 64 of printing device 14.

As can be seen in FIG. 2, separator assembly 22 additionally includes guides 72 and 74 adjacent respective corner relief features 58 and 60. Guides 72 and 74 are designed to lift respective corners 34 and 36 out of corner relief features 58 and 60 before the medium enters feed assembly 64 (see FIGS. 5 and 6). As can additionally be seen in FIG. 2, ribs 76 are formed on or attached to separator assembly 22 so as to be adjacent corner relief features 58 and 60, ramp 62, and guides 72 and 74. Ribs 76 help to support sheet of medium 38 as it travels along separator assembly 22. Ribs 76 also help reduce friction and wear on other parts of separator assembly 22.

Figure 5:
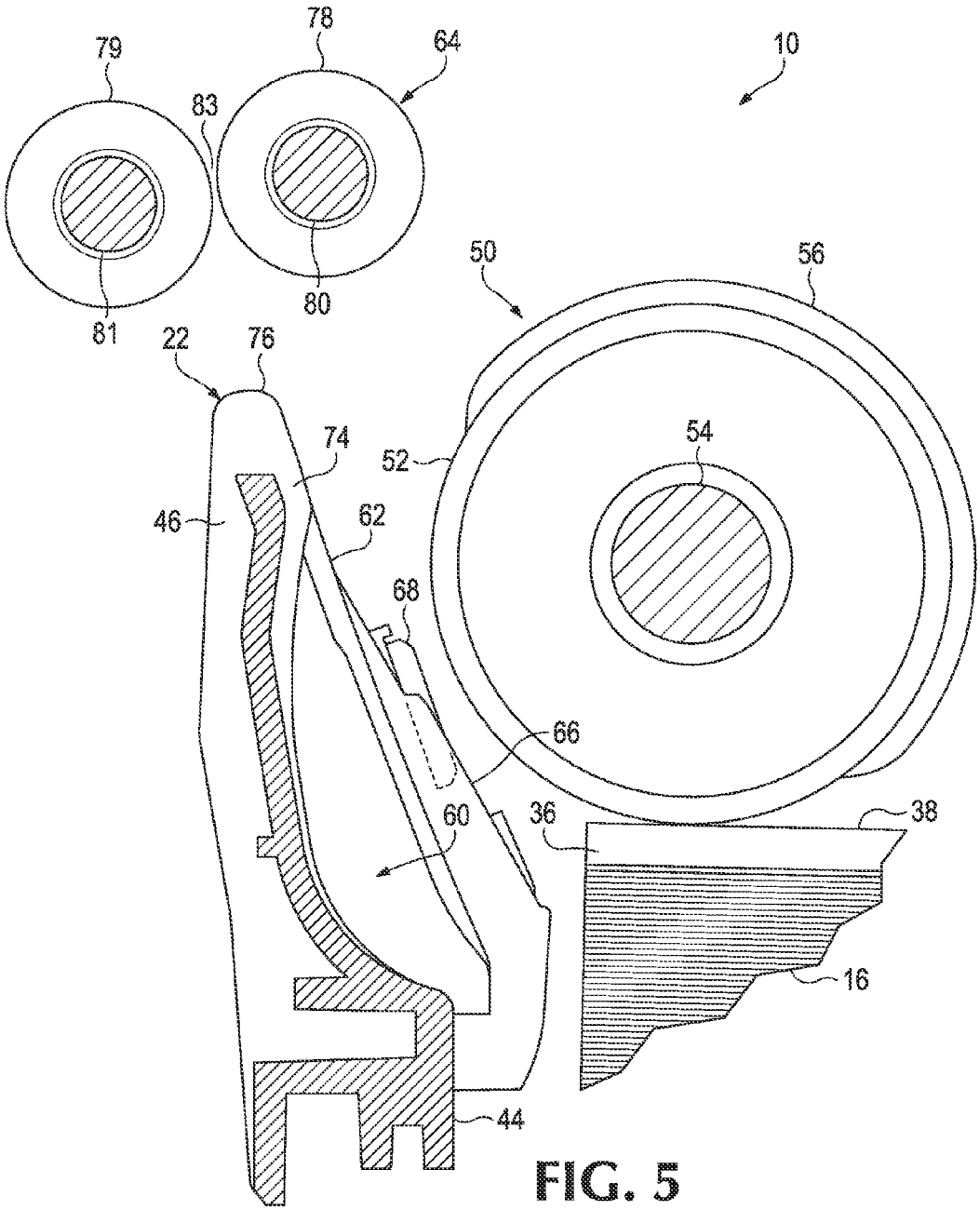
FIG. 5 is a side view of the example of the media handling assembly shown in FIGS. 1-4.

A side view of media handling assembly 10 is shown in FIG. 5. As can be seen in FIG. 5, feed assembly 64 includes a feed tire 78 on a rotatable shaft 80 and a roller 79 on rotatable shaft 81 that, in combination, define a nip 83 to receive sheet of medium 38. Feed tire 78 and/or roller 79 may be made from, for example, an elastomeric material such as rubber to transport sheet of medium 38 to a printing mechanism (not shown) of printing device 14. Feed assembly 64 may include additional components or elements which are not shown in FIGS. 5 and 6.

Figure 6:
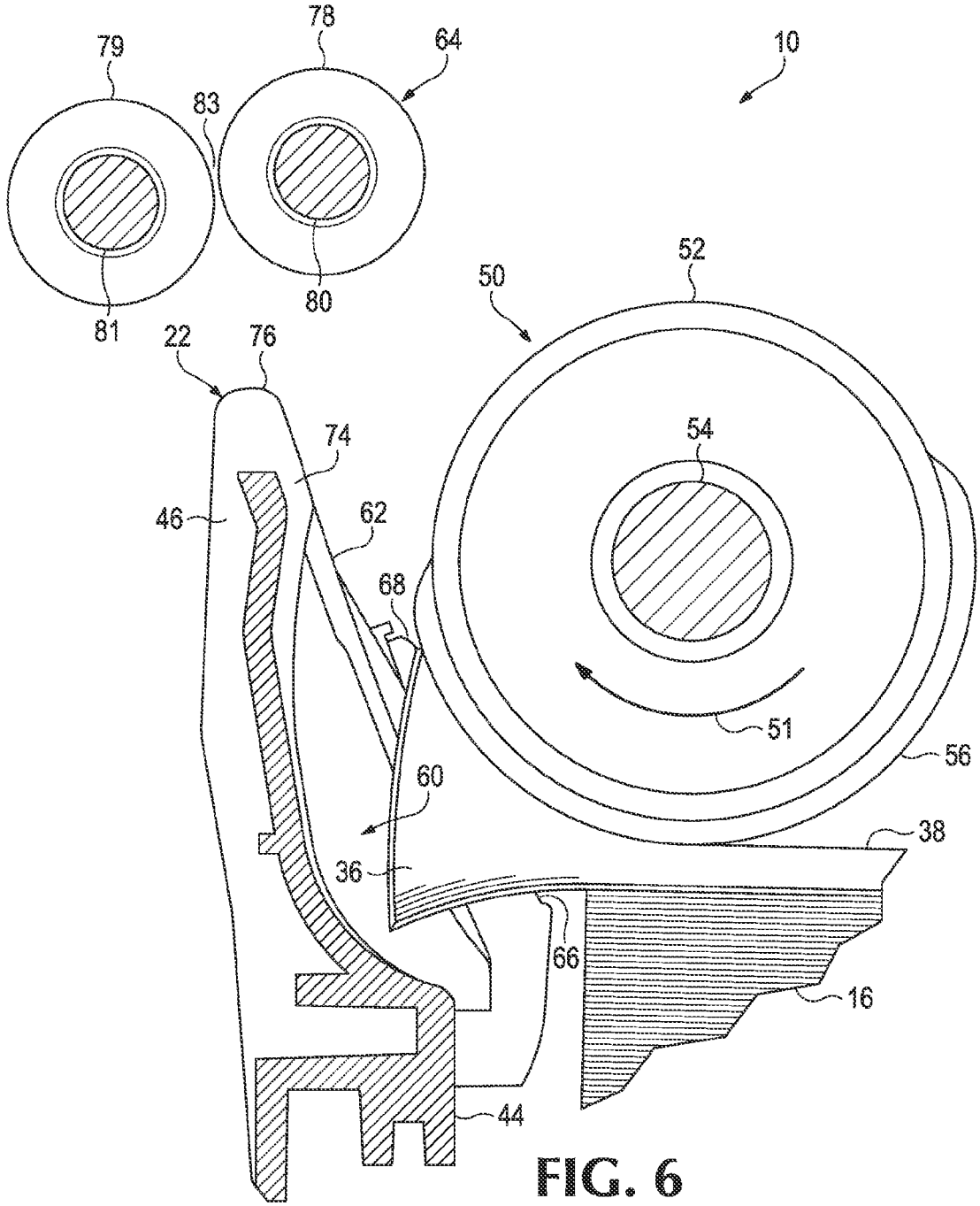
FIG. 6 is a side view of a pick assembly of the media handling assembly of FIG. 5 selecting a sheet of medium from a media stack.

A side view of pick tire 56 of pick assembly 50 of media handling assembly 10 selecting sheet of medium 38 from media stack 16 is shown in FIG. 6. As can be seen in FIG. 6, corner 36 has dropped into corner relief feature 60 and is traveling below the remainder of medium 38 as medium 38 is guided from media stack 16 to feed assembly 64 of printing device 14. As discussed above, this helps alleviate the formation of "dog ears" or corner-folds and the problems associated therewith. Although not shown in FIG. 6, it is to be understood that corner 34 of sheet of medium 38 may have also dropped into corner relief feature 58 and is traveling below the remainder of medium 38 as medium 38 is guided from media stack 16 to feed assembly 64 of printing device 14.

Figures 7, 8:
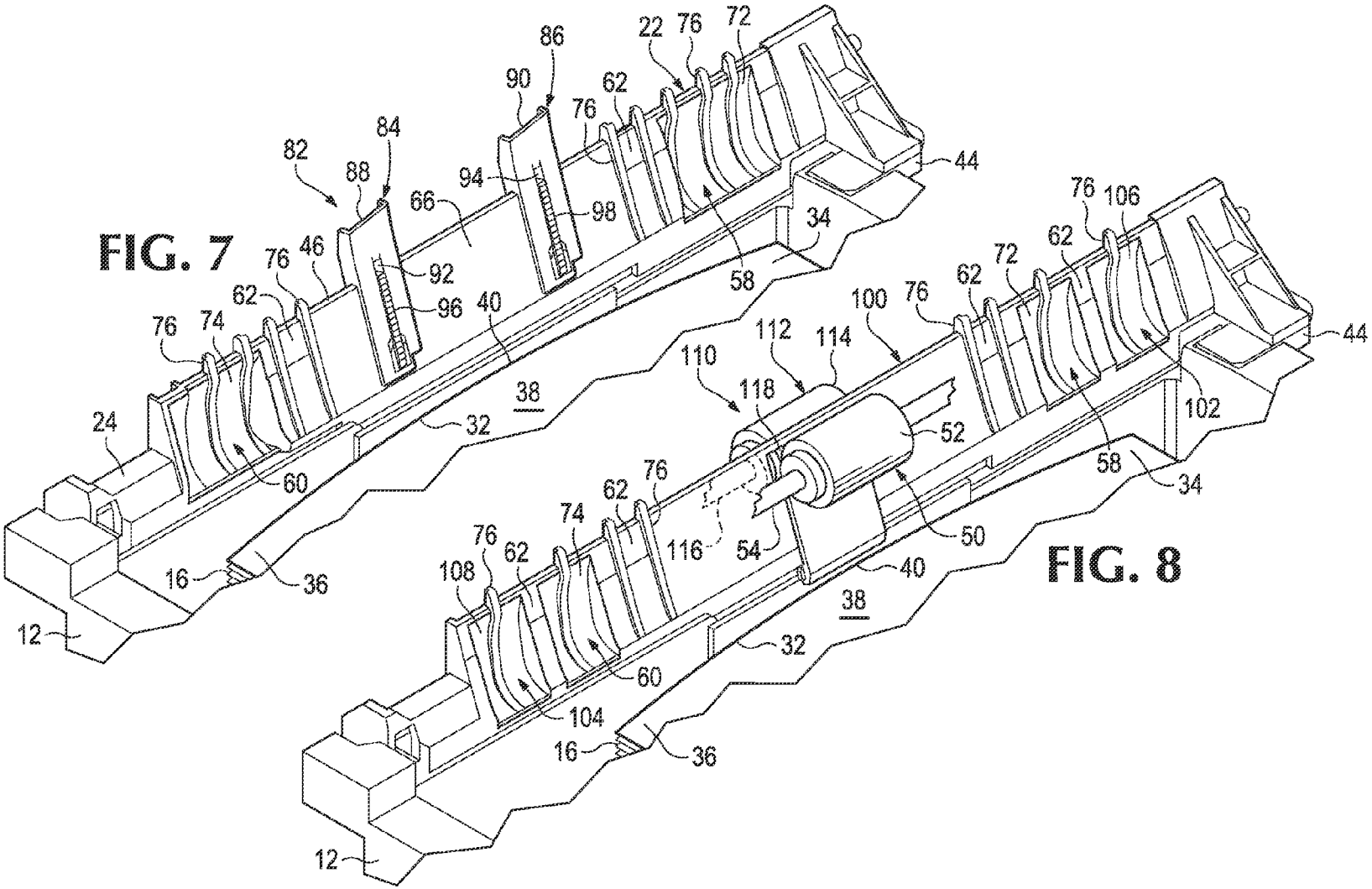
FIG. 7 is an example of an alternative singulation assembly.
FIG. 8 is an example of an alternative separator assembly.

An alternative example of a singulation assembly 82 is shown in FIG. 7. The same reference numerals have been used in FIG. 7, as used in FIGS. 1-6, for structure that remains substantially the same in FIG. 7. As can be seen in FIG. 7, singulation assembly 82 includes serrated block assemblies 84 and 86 that include a pair of members 88 and 90 adjacent inclined plane 66 of separator assembly 22. Members 88 and 90 are configured to define respective openings 92 and 94 in which respective rows of teeth 96 and 98 are disposed. Rows of teeth 96 and 98 are biased to extend outward beyond respective openings 92 and 94 to engage medium 38 during selection by pick assembly 50 (not shown in FIG. 7) to help separate sheet of medium 38 from media stack 16. Rows of teeth 96 and 98 may be biased by a variety of different means such as one or more springs.

An example of an alternative separator assembly 100 is shown in FIG. 8. The same reference numerals have been used in FIG. 8, as used in FIGS. 1-6, for structure of that remains substantially the same in FIG. 8. As can be seen in FIG. 8, separator assembly 100 includes an additional set of corner relief features 102 and 104 on either side of and below ramp 62 into which corners of a different sized medium may drop and travel below a remainder of the different sized medium as the different sized medium is guided from the media stack to feed assembly 64 of printing device 14. In this particular example of separator assembly 100, corner relief features 102 and 104 also extend beyond either side of respective corner relief features 58 and 60 and thus are intended to accommodate a range of wider sized sheets of media than sheet of medium 38. In other examples, corner relief features 102 and 104 may extend on either side of ramp 62 before corner relief features 58 and 60 to accommodate a range of narrower sized sheets of media than sheet of medium 38.

As can also be seen in FIG. 8, corner relief features 102 and 104 include respective guides 106 and 108 that are designed to lift the corners of the different sized media out of corner relief features 102 and 104 before this differently sized media enters feed assembly 64 (not shown in FIG. 8). Corner relief features 102 and 104 also include ribs 76 and may be curved like corner relief features 58 and 60, as shown in FIG. 8.

As can additionally be seen in FIG. 8, separator assembly 100 also has a different example of a singulation assembly 110 that includes a roller separation assembly 112. Roller separation assembly 112 includes a roller 114 on a rotatable shaft 116. Roller 114 is positioned behind inclined plane 66 within an opening 118 defined by inclined plane 66. Roller separation assembly 112 is designed to extend outward beyond respective opening 118 to engage medium 38 during selection by pick assembly 50 to help separate sheet of medium 38 from media stack 16.

Figure 9:
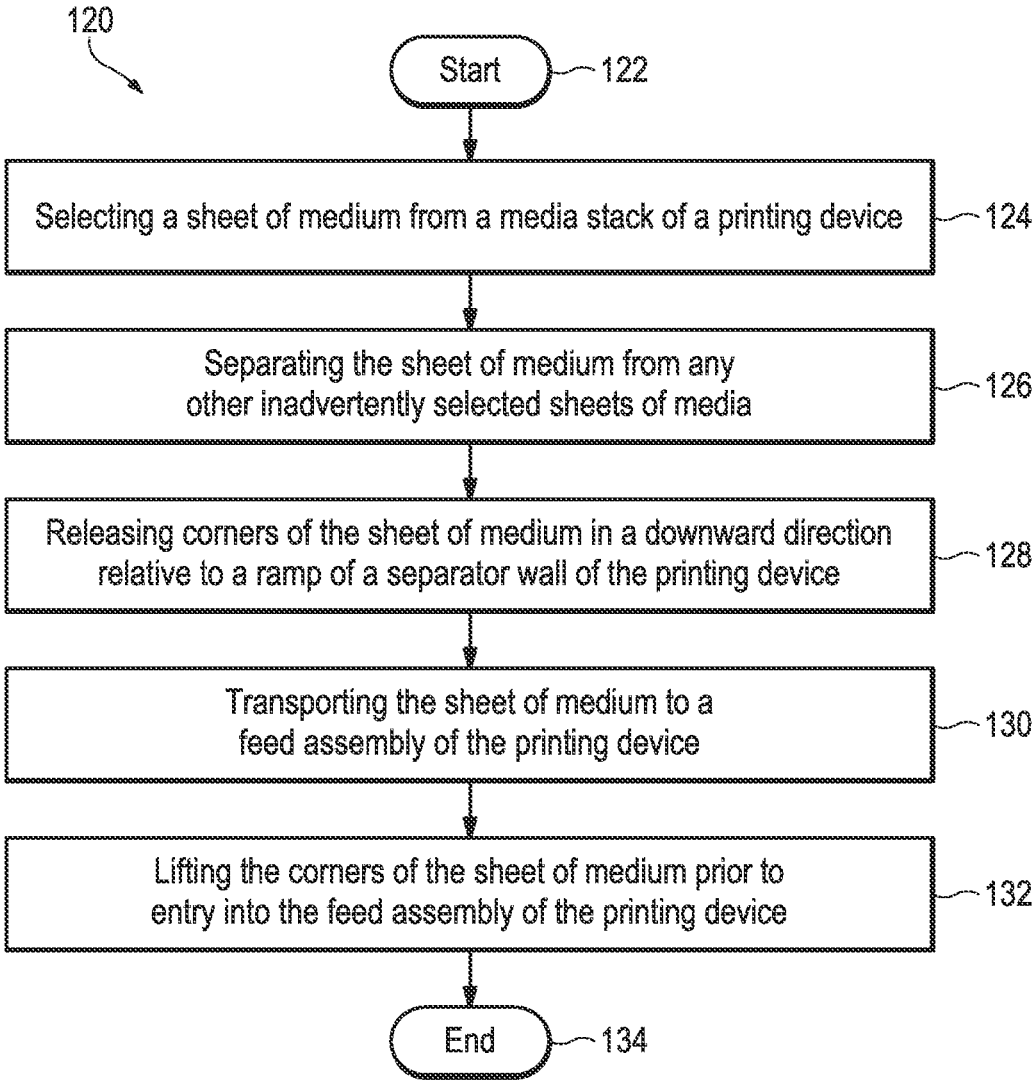
FIG. 9 is an example of a method of media handing.

An example of a method of media handling 120 is shown in FIG. 9. As can be seen in FIG. 9, method 120 begins or starts 122 by selecting a sheet of medium from a media stack of a printing device, as indicated by block 124, and separating the sheet of medium from any other inadvertently selected sheets of media, as indicated by block 126. Next, method 120 continues by releasing corners of the sheet of medium in a downward direction relative to a ramp of a separator wall of the printing device, as indicated by block 128, and transporting the sheet of medium to a feed assembly of the printing device, as indicated by block 130. Method 120 then continues by lifting the corners of the sheet of medium prior to entry into the feed assembly of the printing device, as indicated by block 132, and then ends 134.

Although several examples have been described and illustrated in detail, it is to be clearly understood that the same are intended by way of illustration and example only. These examples are not intended to be exhaustive or to limit the invention to the precise form or to the exemplary embodiments disclosed. Modifications and variations may well be apparent to those of ordinary skill in the art. For example, in other examples of the separator assembly 22, wall 46 and/or ramp 62 may be curved in addition to corner relief features 58 and 60. As an additional example, pick assembly 50 may include a hanging pick arm instead of a pick roller 52 supported by a rotating shaft 54. As a further example, ribs 76 may not be included on separator assembly 22 and/or separator assembly 100. The spirit and scope of the present invention are to be limited only by the terms of the following claims.

Additionally, reference to an element in the singular is not intended to mean one and only one, unless explicitly so stated, but rather means one or more. Moreover, no element or component is intended to be dedicated to the public regardless of whether the element or component is explicitly recited in the following claims.

What is claimed is:

1. A media handling assembly, comprising:

a pick assembly to select a medium from a media stack within an input tray of a printing device;

a feed assembly to transport the medium to a printing mechanism of the printing device; and a separator assembly to singulate the selected medium, the separator assembly including a ramp located above a floor of the input tray to guide the medium from the media stack to a feed assembly of the printing device and a corner relief feature on either side of and below the ramp, each of the corner relief features comprising a recess having a bottom surface that is curved to provide a space beneath a plane of the ramp into which corners of the medium may drop and travel below a remainder of the medium as the medium is guided from the media stack up the ramp and to the feed assembly of the printing device, wherein the space beneath the ramp plane is provided in a direction perpendicular to the ramp plane and away from the guided medium.

2. The media handling assembly of claim 1, further comprising a guide adjacent each corner relief feature to lift the corners of the medium out of the corner relief features before the medium enters the feed assembly.

3. The media handling assembly of claim 2, further comprising ribs adjacent each guide to support the medium.

4. The media handling assembly of claim 1, further comprising ribs adjacent the ramp to support the medium, the ribs extending above the ramp plane.

5. The media handling assembly of claim 1, further comprising a singulation assembly adjacent the ramp to separate the medium from the media stack.

6. The media handling assembly of claim 5, wherein the singulation assembly includes one of a separator pad, a separator roller, an inclined plane, and a serrated block assembly.

7. The media handling assembly of claim 6, wherein the ramp is on either side of the singulation assembly.

8. The media handling assembly of claim 1, wherein the pick assembly includes a pick tire.

9. The media handling assembly of claim 1, wherein the feed assembly includes a feed tire.

10. The media handling assembly of claim 1, further comprising the printing device.

11. The media handling assembly of claim 1, further comprising an additional corner relief feature on either side of and below the ramp into which corners of a different sized medium may drop and travel below a remainder of the different sized medium as the different sized medium is guided from the media stack to the feed assembly of the printing device.

12. A separator assembly, comprising:

a base to mount to a printing device;

a wall supported by the base;

a singulation assembly adjacent the wall to separate a medium from a media stack;

a ramp in the wall adjacent the singulation assembly to guide the separated medium from the media stack to a feed assembly of the printing device;

a corner relief feature comprising a recess extending into the wall on either side of and behind the ramp into which corners of the separated medium may drop and travel below a remainder of the medium as the separated medium is guided from the media stack to the feed assembly of the printing device, the corner relief feature having a bottom surface that is curved; and a guide within the recess of each corner relief feature to lift the corners of the separated medium out of the corner relief features before the separated medium enters the feed assembly.

13. The separator assembly of claim 12, further comprising ribs adjacent the ramp to support the separated medium.

14. The separator assembly of claim 12, further comprising ribs adjacent each guide to support the separated medium.

15. The separator assembly of claim 12, wherein the singulation assembly includes one of a separator pad, a separator roller, an inclined plane, and a serrated block assembly.

16. The separator assembly of claim 12, wherein the ramp is on either side of the singulation assembly.

17. The separator assembly of claim 12, further comprising an additional corner relief feature on either side of and below the ramp into which corners of a different sized medium may drop and travel below a remainder of the different sized medium as the different sized medium is guided from the media stack to the feed assembly of the printing device.

18. A method of media handling, comprising:

selecting a sheet of medium from a media stack of a printing device;

separating the sheet of medium from any other inadvertently selected sheets of media;

releasing corners of the sheet of medium in a downward direction relative to a plane of a ramp of a separator wall of the printing device and into a recess below the ramp plane, the recess having a curved bottom surface;

transporting the sheet of medium to a feed assembly of the printing device, the ramp guiding the sheet of medium from the media stack to the feed assembly; and lifting the corners of the sheet of medium out of the recess prior to entry into the feed assembly of the printing device.

* * * * *